US009078495B2

(12) United States Patent
Rife

(10) Patent No.: US 9,078,495 B2
(45) Date of Patent: Jul. 14, 2015

(54) APPARATUS COMPRISING REMOVABLE LIGHT SOURCE FOR DECORATIVE UTILITY

(76) Inventor: Cherie Rife, Lake Forest, CA (US)

( * ) Notice: Subject to any disclaimer, the term of this patent is extended or adjusted under 35 U.S.C. 154(b) by 198 days.

(21) Appl. No.: 13/545,549

(22) Filed: Jul. 10, 2012

(65) Prior Publication Data

US 2013/0271964 A1 Oct. 17, 2013

Related U.S. Application Data

(60) Provisional application No. 61/624,234, filed on Apr. 13, 2012.

(51) Int. Cl.

| | |
|---|---|
| ***F21V 21/08*** | (2006.01) |
| ***A44C 15/00*** | (2006.01) |
| ***F21V 17/10*** | (2006.01) |
| ***A45C 15/06*** | (2006.01) |
| *F21L 4/00* | (2006.01) |
| *A44C 17/02* | (2006.01) |

(52) U.S. Cl.

CPC ..... *A44C 15/0015* (2013.01); *A45C 15/06* (2013.01); *F21V 17/107* (2013.01); *A44C 17/02* (2013.01); *F21L 4/00* (2013.01)

(58) Field of Classification Search

CPC .... A44C 15/0015; A44C 17/02; A42B 1/242; A47G 2019/2238; A41D 27/085; A45C 15/06; A45C 13/08; F21L 4/00; F21V 23/0414; F21W 2121/00; Y10S 362/806; B65D 2543/00101

USPC ..... 362/104

See application file for complete search history.

(56) References Cited

U.S. PATENT DOCUMENTS

| | | | | |
|---|---|---|---|---|
| 1,712,171 | A * | 5/1929 | Rochas | 63/29.1 |
| 3,689,758 | A | 9/1972 | Power et al. | |
| 4,374,470 | A * | 2/1983 | Isaacson | 63/29.1 |
| 4,802,070 | A | 1/1989 | Westmoland | |
| 4,942,744 | A | 7/1990 | Wei | |
| 5,018,053 | A | 5/1991 | Belknap et al. | |
| 5,201,578 | A | 4/1993 | Westmoland | |
| 5,477,433 | A | 12/1995 | Ohlund | |
| 5,519,591 | A | 5/1996 | McCrary | |
| 5,567,037 | A * | 10/1996 | Ferber | 362/104 |
| 5,653,524 | A * | 8/1997 | Gray | 362/104 |
| 5,876,109 | A * | 3/1999 | Scalco | 362/104 |
| 6,050,695 | A * | 4/2000 | Fromm | 362/104 |
| 6,174,075 | B1 * | 1/2001 | Fuwausa | 362/310 |
| 6,288,498 | B1 * | 9/2001 | Cheng | 315/185 S |
| 6,433,483 | B1 | 8/2002 | Michael et al. | |
| 6,659,617 | B1 | 12/2003 | Michael | |
| 6,773,133 | B2 * | 8/2004 | Lee | 362/121 |
| 6,833,539 | B1 * | 12/2004 | Maeda | 250/214 AL |
| 6,928,834 | B2 * | 8/2005 | Robertson et al. | 63/27 |
| 7,064,498 | B2 | 6/2006 | Dowling et al. | |
| 7,131,745 | B2 * | 11/2006 | Sibbett | 362/106 |
| 7,367,684 | B2 | 5/2008 | D'Souza | |
| 8,425,072 | B2 * | 4/2013 | Hurwitz | 362/103 |
| 2004/0213088 | A1 | 10/2004 | Fuwausa | |
| 2007/0153497 | A1 * | 7/2007 | Chang | 362/103 |

* cited by examiner

*Primary Examiner* — Jong-Suk (James) Lee
*Assistant Examiner* — Alexander Garlen
(74) *Attorney, Agent, or Firm* — Alexander Chen, Esq.

(57) ABSTRACT

Apparatus for decorative utility comprising an ornament unit, a base unit, and a lighting unit, wherein the lighting unit comprises of a circuit board, power source such as battery, and at least one light source, such as a light emitting diode. The ornament unit is interchangeable, and can be disengaged and mounted onto the same or different base unit. The lighting unit may include one or more light sources, wherein the color and/or levels of intensity of the illumination can be modified and controlled.

25 Claims, 10 Drawing Sheets

APPARATUS COMPRISING REMOVABLE LIGHT SOURCE FOR DECORATIVE UTILITY

INCORPORATION BY REFERENCE

This application claim the benefit of priority under 35 U.S.C. 119(e) to the filing date of U.S. provisional patent application No. 61/624,234 "Apparatus Comprising Removable Light Source for Decorative Utility" which was filed on Apr. 13, 2012, and which is incorporated herein by reference in its entirety.

FIELD OF THE INVENTION

The present invention relates generally to the field of jewelry and more specifically to apparatus for interchanging ornaments with interchanging light sources for a jewelry article. Particularly, the invention deals with movable jewelry wherein the ornaments for decoration displayed can be illuminated, positioned, and modified as desired by the user with certain prescribed possibilities.

BACKGROUND OF THE INVENTION

Jewelry pieces are conventionally permanent. In other words, once a jewel is fixed within a setting, the jewel and the setting may only be used or worn as a combined unit on one part of the body. In fact, most jewelry designs include some sort of gemstone set in a mounting, and possibly associated with some sort of aesthetic design element (e.g. engraving, finish, etc.). The mounting, the gemstone, the aesthetic design, and the functional components (e.g. additional material to attach item to the body, etc.) are typically fashioned in such a way that they form a single static unit. That is, the gemstone is permanently set in the mounting, and the mounting is permanently attached to the rest of the piece (e.g. attached to a belt, bracelet or an earring post). This provides the jewelry wearer with one look for every item purchase. This can be quite limiting. Thus, there is a need for a jewelry system which will allow for a more economic and personalized jewelry experience where one or a combination of other more affordable purchases can provide many looks.

Interchangeable jewelry settings that overcome such a limitation are known. Various enhancements to this static jewelry style have been proposed in the prior art. Usually, interchangeable jewelry settings allow a variety of stones or jewels to be used with a single setting. Therefore, many of the designs in the prior art focused on the exchange of the gemstone itself, and therefore modify the mechanical design of the mounting by adding some attachment mechanism to hold and release the gemstone.

Generally, the user is manipulating loose gemstones, many of which are small and/or not colored (e.g. diamonds) and are therefore difficult to see and hold. Thus, this kind of design increases the likelihood that an expensive gemstone can be lost. Other prior art does focus on the interchangeability of larger sections of the jewelry piece, such as the mounting and the stone together in one unit. However, it is difficult to devise a mechanism which provides the interchangeability without affecting the aesthetic nature of the jewelry. Since jewelry is a fashion item, the aesthetics of the piece is very important, and any additional lines, creases, cracks, gaps, hinges, or clasping mechanism, etc., which are visually present and/or obtrusive to the observer will detract significantly from desirability, and thus the marketability, of the design.

Jewelry articles with interchangeable ornaments and adapters for adapting one type of jewelry article into another type are well known in the art. However, a significant drawback of interchangeable jewelry has been the less than ease of use, less than secure mounting of the valuable feature unit onto the base unit, and the resulting unfortunate inadvertent loss of the valuable feature unit during normal wearing. Furthermore, commercially available interchangeable jewelry apparatus often have interchanging apparatus for connecting the separable portions that is usually large and unsightly. It is a primary objective in creating an interchangeable jewelry article that the interchanging apparatus be easy to handle. If the apparatus is too small or difficult to handle, most consumers will quickly become discouraged and discontinue use. However, another important object in designing interchangeable jewelry articles is that the interchanging apparatus be substantially hidden from view when the jewelry article is assembled for wear. It is obvious that these two objectives are contradictory in nature. One objective requires that the apparatus be large enough to be easily handled while the other objective requires that the apparatus be small enough to conceal. In order to achieve both objectives, the prior art devices have traditionally been limited to use on jewelry articles having large ornaments with adequate surface area for mounting of the apparatus and for obstructing view of the apparatus.

The lack of a simple, durable, easy to use by the consumer, and yet effective securing means in the prior art for interchangeable jewelry, among other factors, has contributed not insignificantly to the unpopularity of such interchangeable jewelry notwithstanding the appreciation and recognition by some of the desirability, flexibility and associated low cost advantages of the same.

Illuminated jewelry has been known in the art for some time, such as illuminated earrings, lighted pendants, and lighting devices for jewelry. These prior arts, however, have their own limitations. Among the list of limitations are fragility, complexity of design, placement and interchangeability of the LED and/or PCB or other connectivity apparatus, unattractiveness, inability to market, non-versatile, costly to develop, costly to manufacture different ornamental attachments, and limited ornamental adaptability.

More specifically, most items involve a complex construction or electrical circuit which renders assembly difficult and expensive. Other constructions require careful manipulation of the electrical contacts between the illuminating member and the battery. A primary shortcoming in most illuminated jewelry is that separate contact means for establishing the electrical connection with the battery must be fabricated and added to the jewelry item.

OBJECTIVE OF THE INVENTION

Accordingly, it is an object of the invention to provide an apparatus comprising a housing having an ornament unit and a base unit.

It is also an objective of the invention to provide within the housing, a lighting unit comprising a printed circuit board (PCB) or other connectivity apparatus with light emitting diodes (LED) or other light sources and a battery unit or other power source.

It is an object of the invention to provide a jewelry setting comprising an interchangeable ornament having a securing means, wherein the ornament can be disengaged from the base and selectively mounted securely on a different base.

It is also an object of the invention to provide an interchangeable or securing mechanism that is substantially concealed from view when the separable portions of the housing—the ornament and the base portions—are received in engagement.

It is also an object of the invention to provide a jewelry setting having a low cost, easy to use securing means for an interchangeable ornament.

It is also an object of the invention to provide a jewelry setting that presents inadvertent disengagement of an ornament or gem from the body of the jewelry.

It is an object of the invention to provide a jewelry setting that allows an average consumer/user to interchange the ornament unit with or without the aid of any tool. It is also an object of the invention to provide a jewelry setting with versatile lighted ornament that can be adapted and utilized for body jewelry, or attached to clothing apparel, shoes and accessories, or objects that humans utilize.

It is also an object of the invention to provide a jewelry setting with lighted ornaments, wherein the light source can be replaced or interchanged with different types of colored LEDs or other light source.

It is also an object of the invention to provide an apparatus that can be manufactured quickly, efficiently, and inexpensively.

It is also an object of the invention to provide an apparatus that is more durable and that requires little upkeep.

It is also an object of the invention to provide an apparatus with a light source having an elegant and simple design for controlling the lights to turn the light on and off and to dim the light It is also an object of the invention to provide the apparatus with a switch, sensor, pressure or button mechanism for controlling the on/off, color and/or intensity of illumination of the light source.

SUMMARY OF THE INVENTION

Disclosed is a utility invention of an apparatus wherein one or a series of light emitting diodes (LED) or other light emitting source is embedded within a base unit wherein said light is removable for switching to different colors or quantities of said light emitting source wherein said light contains an integrated circuit and a battery or other power source wherein said light may or may not have a battery or other power source placed within close proximity of said light wherein said battery or other power source may power more than one said light source that may be integrated into many areas of the article to be decorated wherein said light is further behind and/or within and/or around the circumference of the translucent or transparent ornament, wherein the ornament is mounted on said base unit such that the ornament is or is not removable for different colored/material type ornament. In one embodiment the apparatus is embedded on/in or attached to guitar straps or any other straps made for carrying articles, in one embodiment the apparatus is embedded on/in or attached to necklaces, in one embodiment the apparatus is embedded on/in or attached to a bracelet, in one embodiment the apparatus is embedded on/in or attached to a cuff, in one embodiment the apparatus is embedded on/in or attached to eyeglasses, in one embodiment the apparatus is embedded on/in or attached to a tie, in one embodiment the apparatus is embedded on/in or attached to a tie clip, in one embodiment the apparatus is embedded on/in or attached to a brooch, in one embodiment the apparatus is embedded on/in or attached to an earring, in one embodiment the apparatus is embedded on/in or attached to a belt, in one embodiment the apparatus is embedded on/in or attached to a belt buckle, in one embodiment the apparatus is embedded on/in or attached to a ring, in one embodiment the apparatus is embedded on/in or attached to hair or head accessories, in one embodiment the apparatus is embedded on/in or attached to purses, handbags, briefcases or any other device made for carrying articles, in one embodiment the apparatus is embedded on/in or attached to shoes, in one embodiment the apparatus is embedded on/in or attached to wine glass charms, in one embodiment the apparatus is embedded on/in or attached to napkin holders, in one embodiment the apparatus is embedded on/in or attached to key rings, in one embodiment the apparatus is embedded on/in or attached to clothing, in one embodiment the apparatus is embedded on/in or attached to buttons, in one embodiment the apparatus is embedded on/in or attached to all types of body jewelry, in one embodiment the apparatus is embedded on/in or attached to a picture frame, in one embodiment the apparatus is embedded within or further behind the foremost art of a wall hanging or table top art piece, in one embodiment the apparatus is embedded on/in or attached to a cellular phone case, in one embodiment the apparatus is embedded on/in or attached to a wallet wherein said apparatus may or may not further comprise of a power intensity adjustment apparatus wherein said power intensity adjustment apparatus is but not limited to a slide able switch and/or a touch pad sensor or button.

In one embodiment, the apparatus comprises of a base and an ornament unit, wherein said ornament can be depressed to activate a mechanism within the apparatus causing the intensity or color or pattern of the illumination to change as well as power on or off.

In one aspect of the invention, a light emitting apparatus is disclosed for decorative function wherein the apparatus is comprised of a base unit; a first ornament unit wherein the first ornament unit is mounted on the base unit; the base unit further comprises a first light unit wherein the first light unit emits light through the first ornament unit when the first ornament unit is mounted on the base unit; the first light unit is encased within the base unit; the first light unit is removable from the base unit and replaceable by a second light unit; the first ornament unit is removable from the base unit and replaceable by a second ornament unit. In one embodiment, the base unit further comprises a switch unit wherein the switch unit controls the lighting of the light unit. In one embodiment, the first and second light units are comprised of one or more light sources, one or more power sources. In one embodiment, the first and second light units are further comprised of at least a circuit board or other connectivity apparatus. In one embodiment, the first light unit emits different light than the second light unit. In one embodiment, the first light unit emits different light pattern than the second light unit. In one embodiment, the ornament unit is comprised of at least one gem stone. In one embodiment, the one or more light sources is comprised of one or more light emitting diodes. In one embodiment, the apparatus is mounted on an accessory. In one embodiment, the switch is a pressure button positioned between the ornament unit and the base unit wherein application of pressure on the ornament unit activates the switch wherein the switch controls the intensity or color or pattern of the light unit. In one embodiment, the first and second light units are further comprised of at least a switch.

In another aspect of the invention a method to illuminate an ornament is disclosed comprising utilizing a light emitting apparatus for decorative function wherein the apparatus is comprised of a base unit; a first ornament unit wherein the first ornament unit is mounted on the base unit; the base unit further comprises a first light unit wherein the first light unit emits light through the first ornament unit when the first ornament unit is mounted on the base unit; the first light unit is encased within the base unit; the first light unit is removable from the base unit and replaceable by a second light unit; the first ornament unit is removable from the base unit and replaceable by a second ornament unit. In one embodiment, the base unit further comprises a switch unit wherein the switch unit controls the lighting of the light unit. In one embodiment, the first and second light units are comprised of one or more light sources and one or more power sources. In one embodiment, the first and second light units are further comprised of at least a circuit board or other connectivity apparatus. In one embodiment, the first light unit emits different light than the second light unit. In one embodiment, the first light unit emits different light patterns than the second light unit.

In another aspect of the invention, a light emitting apparatus is disclosed for decorative function wherein the apparatus is comprised of a base unit; an ornament unit wherein the ornament unit is mounted on the base unit; the base unit further comprises a portable unit wherein the portable unit comprises a light unit wherein the light unit emits light through the ornament unit when the ornament unit is mounted on the base unit and when the portable unit is within the base unit; the light unit is encased within the portable unit; the portable unit is removable from the base unit; the ornament unit is removable from the base unit; the light unit is removable from the portable unit. In one embodiment, the base unit is further comprised of an opening allowing for the portable unit to be removed from the base unit. In one embodiment, the opening is a swing gate or a back door. In one embodiment, the base unit is comprised of a top cover and a bottom cover wherein the ornament unit is mounted on the top cover. In one embodiment, the light unit is comprised of one or more light sources and one or more power sources. In one embodiment, the first and second light units are further comprised of at least a circuit board or other connectivity apparatus.

In another aspect of the invention, a light emitting apparatus for decorative function is disclosed wherein the apparatus is comprised of a base unit and a portable ornament light unit wherein the portable ornament light unit is comprised of an ornament unit and a portable unit wherein the ornament unit is mounted on the portable unit; the portable unit further comprises a light unit wherein the light unit emits light through the ornament unit when the ornament unit is mounted on the portable unit; the portable ornament light unit is encased within the base unit; the portable ornament light unit is removable from the base unit; the ornament unit is removable from the portable unit; the light unit is removable from the portable unit. In one embodiment, the base unit is further comprised of an opening allowing for the portable ornament light unit to be removed from the base unit. In one embodiment, the opening is a swing gate or a back door. In one embodiment, the base unit is comprised of a top cover and a bottom cover wherein the light unit is encased within the top cover and the bottom cover. In one embodiment, the light unit is comprised of one or more light sources and one or more power sources. In one embodiment, the ornament unit is mounted on an ornament mounting bracket wherein the ornament mounting bracket is mounted on the portable unit via at least one attachment device.

DETAIL DESCRIPTION OF THE INVENTION

Figure 1:
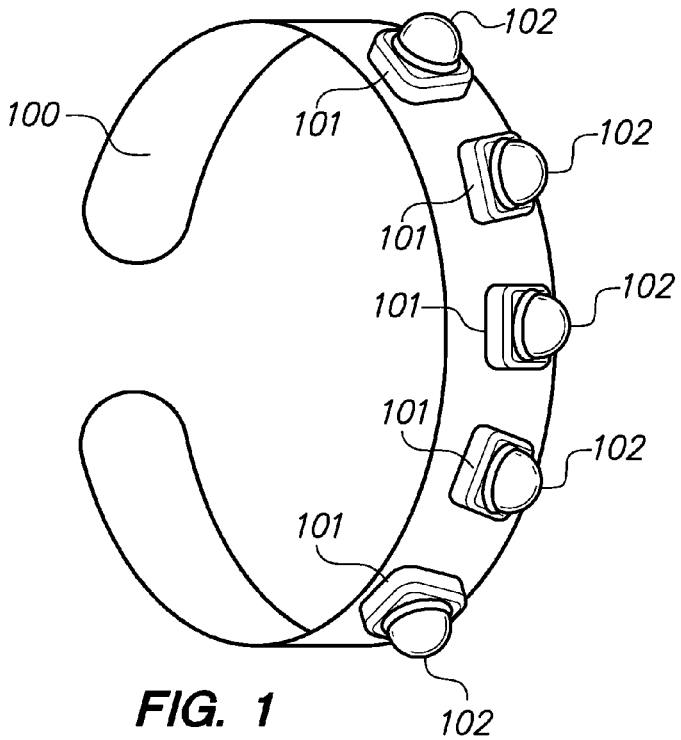
FIG. 1 is a perspective view of one embodiment of the basic construction of a hard bracelet using the present invention.

The present invention accomplishes these objectives and overcomes the disadvantages in the prior art. Since, in most cases, the apparatus will either be attached or connected to the human body directly in some fashion (e.g. a metal rod passed through the earlobe for an earring), or indirectly via a mechanism that furthers attaches to the human body (e.g. a connector to a necklace chain), it is possible that one of the interchangeable jewelry segments in a custom jewelry assembly can be an interchangeable jewelry base. It is also possible that the base portion can be a separate unit that can be attached to another article (e.g. attaching the base to a belt), upon which an ornament can then be attached.

The base portion preferably includes an engagement formation, and the ornament portion includes a complimentary engagement formation. When the engagement surfaces of the base and ornament portions are received in engagement, the ornamental surfaces thereof cooperatively merge so that the base portion and ornament portion appear as an integral unit. Furthermore, it is preferable that the engagement of the ornament and the base unit is easy and efficient, and is also well-concealed as to be aesthetically pleasing.

More specifically, the present invention disclosed within comprises of an ornament unit and a base unit. Within the base unit is a lighting unit comprising of at least one or more light emitting diode ("LED") or other light sources, with or without a printed circuit board (PCB), and a battery or other power source and a switch to control the illumination. The light source, with or without the PCB, and the battery or other power source are connected via circuitry as to provide illumination to the ornament portion of the apparatus. The light source can be from a natural source or from an artificial source which can be a LED light. The light source can also be lighted and powered by a battery or any other power source, and the battery or power source may be near or separated from the PCB and lighting unit. Furthermore, the light source inside may be interchangeable for versatility purposes, such as to provide for different degrees or intensity of illumination or different colors of illumination or more than one light source.

The ornament can be made from one or more of the various types of material, such as stone, metal, plastic, glass, leather, cloth, synthetic material, etc. It is, however, preferable that the ornament is made of material that is transparent or semi-transparent or translucent, as the ornament is to be illuminated by a light source embedded in the base unit. It is also preferable that the ornament is made of a scratch resistant material to minimize scratches or other damages.

The base portion can also be made of the same or different material as that of the ornament. The base portion preferably should be made of a durable material which allows easy and efficient swapping of the lighting unit illuminating the ornament. Moreover, it is preferable, at least in some circumstances, that the base portion be light in weight to accommodate its use in areas such as glasses, tie clips, cuff links, rings, earrings, etc. Also, it is preferable that the base portion be thin or small to allow easier installation or to complement the items to be decorated so as to be more aesthetically pleasing.

A mechanism is embedded within the base or ornament portion to allow for the control of the color and/or intensity and/or powering on/off of the illumination. The controlling mechanism can be a button, a switch, a touch sensor, wireless receiver, etc. The control can also be a set of colors and/or intensity of illumination or it can be a sliding scale of colors and/or intensity of illumination. Furthermore, the mechanism for controlling the color or intensity of the illumination or for turning the illumination on or off can also be in the form of a touch or pressurized sensor, wherein upon pressing down and allowing the ornament to revert back to its original position, the color or intensity of the illumination changes or the illumination turns on or turns off.

In one embodiment of the invention disclosed herein, the apparatus is comprised of an ornament unit attached to the base unit. The base unit is further comprised of a top cover, a bottom cover, and a light unit, wherein the light unit is comprised of a light source, and power source. The light source can further be comprised of a connectivity apparatus such as a circuit board and a control switch.

In another embodiment of the invention, the apparatus is comprised of a base unit and a portable unit, wherein the portable unit can slide out from the base unit through a swing gate or a back door on the base unit for interchanging the portable unit. The ornament unit is attached to the base unit itself, whereas the connectivity apparatus, light source, and power source and control switch is contained within the portable unit.

In yet another embodiment of the invention, the apparatus is comprised of a base unit, an ornament mounting bracket unit, and a portable unit, wherein the portable unit can slide out from the base unit through a swing gate or a back door on the base unit for interchanging the portable unit. The ornament unit attaches to the ornament mounting bracket, which in turns attaches to the portable unit.

The present invention disclosed herein can include the use, for example, of one or more batteries or other power sources or a combination of different types and sizes of batteries or other power sources for brighter or longer illumination. Furthermore, the size and placement of the batteries or other power sources can also differ depending on the placement and design of the item to be decorated. For example, a bigger power source may be used for purses to provide more electrical energy to power more light sources at a higher illumination or for a longer period of time. For placement of the apparatus on cufflinks, rings, etc., for example, the batteries or other power sources can be smaller to accommodate the availability of space as well as to be more aesthetically pleasing.

The light source embedded within the lighting unit can be any type of light emitting source, although light emitting diode (LED) is preferred. This is because LED is small in size, light in weight, does not generate much heat, low in power consumption, has a long useable life term, and does not damage as easily.

The term "ornament" is to be construed broadly throughout this invention to mean any article or material having optical reflective and/or refractive properties, whether translucent or non-translucent, including but not limited to jewels, gemstones, decorated stones, transmissive light objects, precious stones, pearls, glass, plastic, and many aesthetically pleasing object, e.g. white and color diamonds (yellows, reds, pinks, purples, blues, greens, etc), rubies, semi-precious stones, quartz, sapphires, emeralds, shells, turquoise, coral, and imitations of these stones made from artificial materials or small reflective metallic objects. In particular, the placement of a light behind different types of ornaments such as a pearl or a piece of quartz may create refracted illumination through the ornament due to its natural inclusions (as opposed to simply from just the cut or shape of the ornament).

Those skilled in the art can now appreciate from the foregoing description that the broad techniques of the embodiments of the present invention can be implemented in a variety of forms. The present invention disclosed herein can be used for accessories such as jewelry, such as earrings, necklaces, bracelets, pedants, anklets, or other body jewelries, or it can also be applied to any article of clothing, shoes, etc. The apparatus of the present invention can be applied to purses, handbags, satchels, briefcases, laptop cases, etc. The apparatus can also be applied to jeans, shirts, skirts, blouses, underwear, glasses, belts, buckles, tie clips, cuff links, shoes, hat, hatband, frames, artworks, wine glass identifiers, napkin holders, flashlight, nightlight, key ring, door handle to cars, interior light runner in cars, laptops, cellular phones, furniture, household goods such as chairs and tables, fixtures, chandeliers, etc.

Although the present invention describes several types of jewelry in particular, other uses can also be implemented without departing form the spirit of the present invention, such as collars, mouse pad and clothing buttons. Furthermore, the apparatus disclosed herein can be used on straps for carrying items, ties, cuffs, bracelets, brooches, tie clips, earrings, belts, hair or headband, wine glass charms, napkin holders, and key rings, among other items. Therefore, while the embodiments of the present invention have been described or mentioned in connection with particular examples thereof, the true scope of the embodiments of the invention should not be so limited since other modifications, whether explicitly provided for by the specification or implied by the specification, will become apparent to the skilled practitioner upon a study of the drawings and specifications.

DETAIL DESCRIPTION OF THE DRAWINGS

Referring to FIG. 1, an embodiment of a hard bracelet 100 with embedded apparatus of the present invention 101, in which within each of the apparatus 101 contains a ornament unit 102 that is detachable and interchangeable. The bracelet 100 itself can be made of metal such as stainless steel, precious metal such as platinum or gold, plastic, or any other material suitable for a hard bracelet. The apparatus 101 can be made of various types of materials such as plastic, glass, crystal, metal or any other material, and it is preferable that the ornament unit 102 be made of a transparent or translucent material as to allow the illumination from the light source to be visible.

Figure 2:
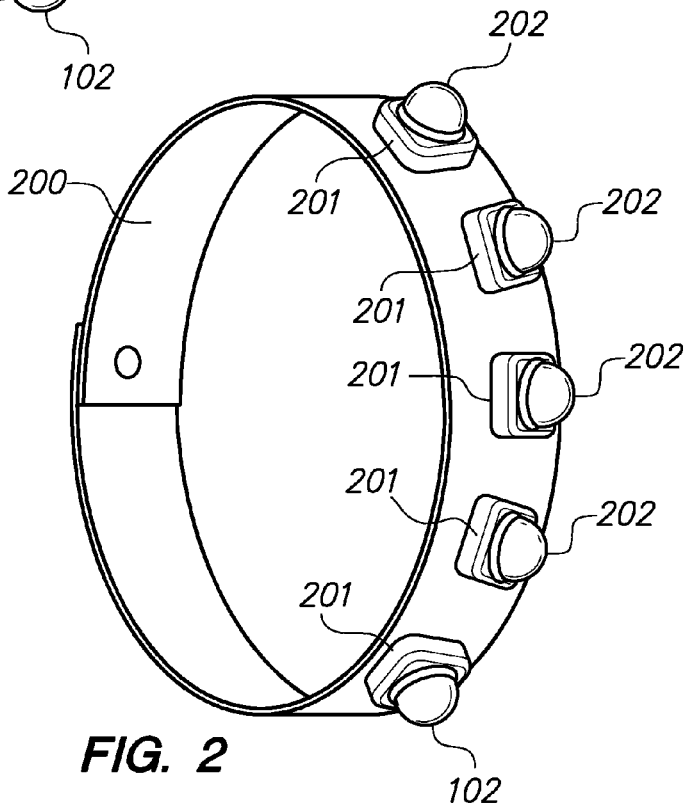
FIG. 2 is a perspective view of one embodiment of the basic construction of a leather bracelet using the present invention.

Referring to FIG. 2, an embodiment of a soft bracelet 200 with embedded apparatus of the present invention 201, in which within each of the apparatus 201 contains a ornament unit 202 that can be separated and reattached in various combinations as desired. The bracelet 200 itself can be made of materials such as canvas, leather, silk, or any other material suitable for a soft bracelet. As before, each apparatus 201 contains an ornament unit 202 that can be made of various types of materials such as plastic, glass, crystal, or any other material. Preferably, the ornament unit 202 made of a transparent or translucent material as to allow the illumination from the light source to be visible.

Figure 3:
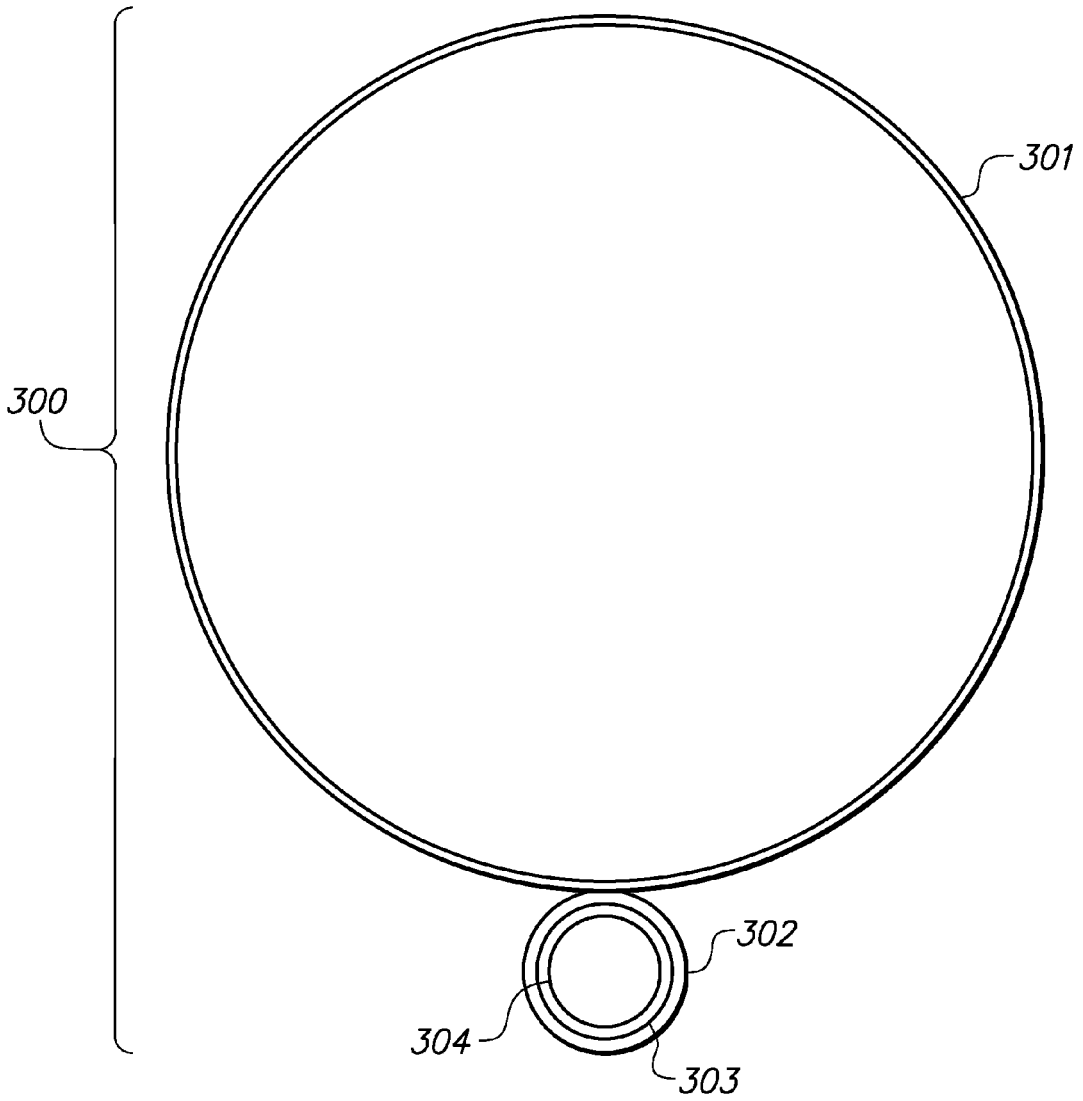
FIG. 3 is a perspective view of one embodiment of the basic construction of a necklace using the present invention.

Referring to FIG. 3, an embodiment of a necklace 300 with a chain 301 and charm 302 with an apparatus of the present invention 303 embedded in it, wherein the apparatus 303 contains an interchangeable ornament unit 304. The apparatus of the present invention 303 can also be attached directly to the chain 301. As before, the necklace chain 301, the charm 302, the apparatus 303, and the ornament unit 304 can be made up of a variety of materials.

Figure 4:
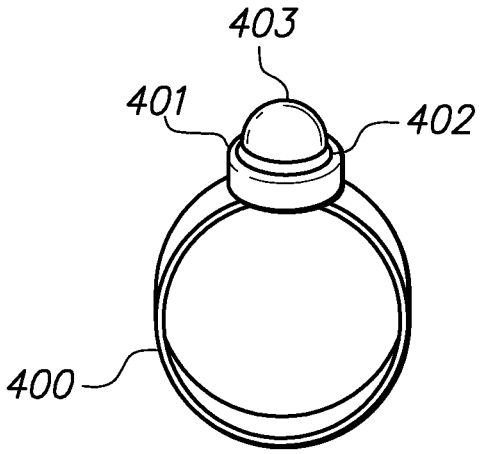
FIG. 4 is a perspective view of one embodiment of the basic construction of a ring using the present invention.

Referring to FIG. 4, an embodiment of a ring 400 with setting 401, wherein an apparatus of the present invention 402 is embedded in the center of the setting 401. The apparatus 402 contains an interchangeable ornament 403. The apparatus 402 can also be mounted on the ring 400 without being placed within the setting 401. Again, the ring 400, the setting 401, the apparatus 402, and the ornament 403 can be any of a variety of materials.

Figure 5:
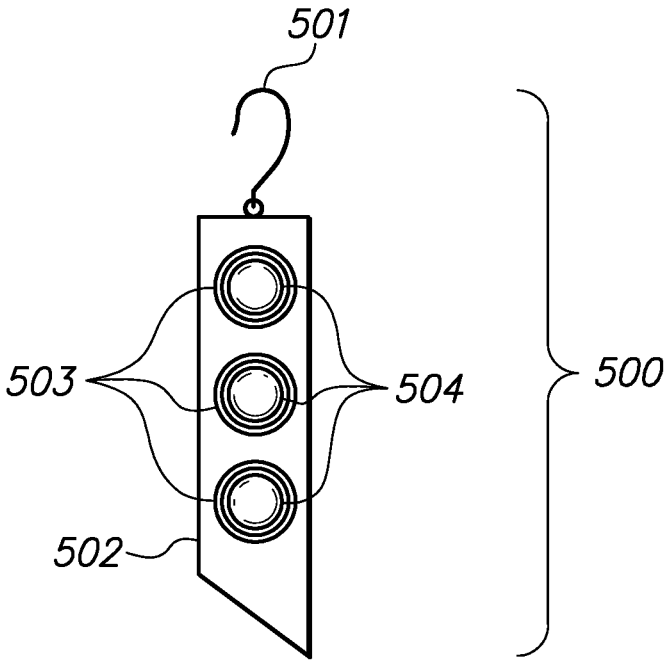
FIG. 5 is a perspective view of one embodiment of the basic construction of an earring using the present invention.

Referring to FIG. 5 is an embodiment of an earring 500, with a hook 501, and a charm 502. Embedded within the charm 502 are apparatus 503 of the present invention disclosed herein, wherein the ornament unit 504 of the apparatus 503 is interchangeable. The apparatus 503 can also be attached directly to the hook 501. The hook 501, the charm 502, the apparatus 503, and the ornament 504 can be made of any of a variety of materials as desired.

Figure 6:
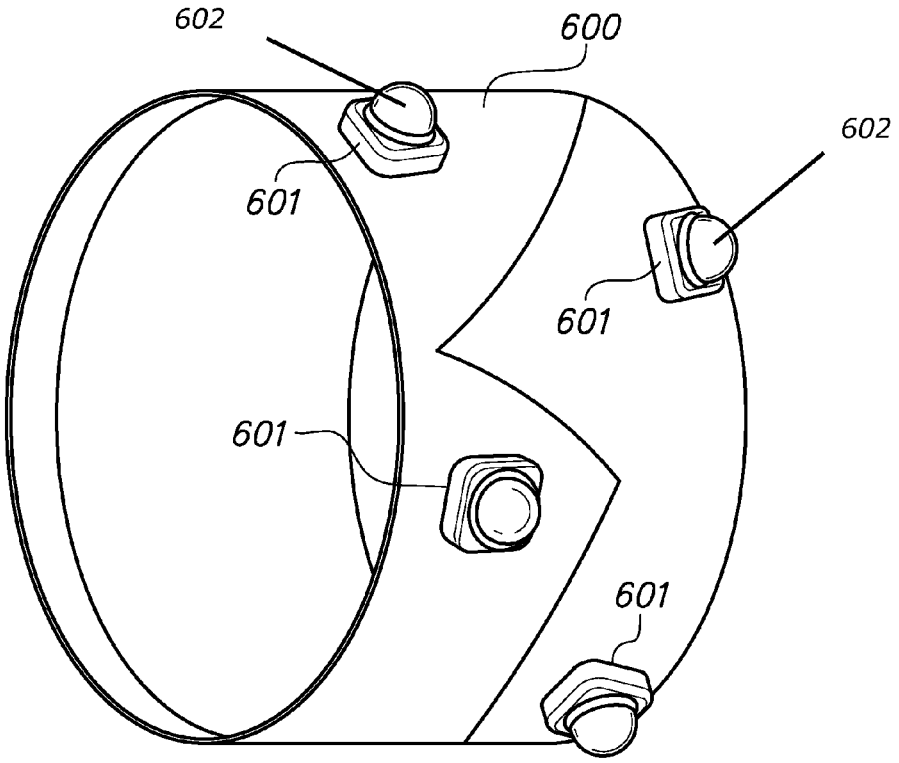
FIG. 6 is a perspective view of one embodiment of the basic construction of a cuff using the present invention.

Referring to FIG. 6, an embodiment of a cuff 600 with apparatus of the present invention 601 embedded, wherein the interchangeable ornaments 602 are embedded within the apparatus 601. The cuff 600, the apparatus 601, and the ornaments 602 can be of any material.

Figure 7:
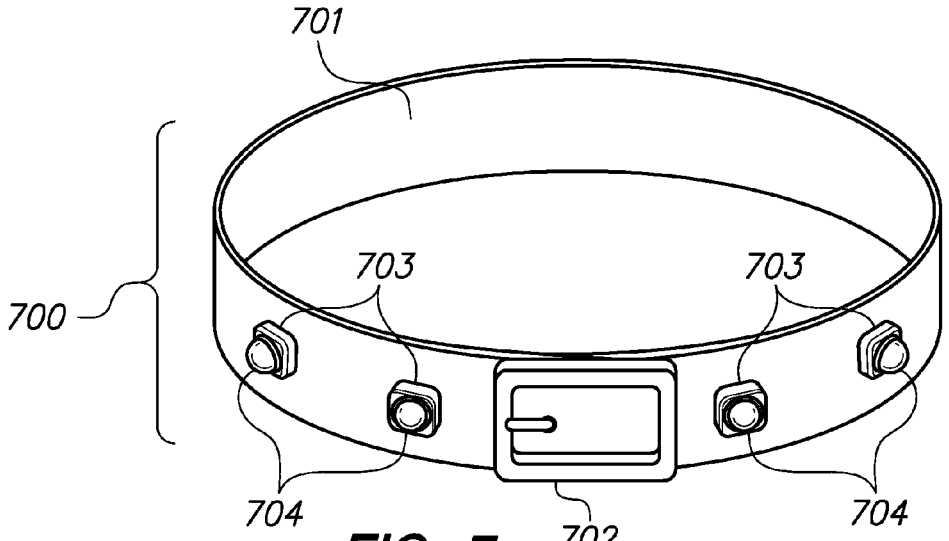
FIG. 7 is a perspective view of one embodiment of the basic construction of a belt using the present invention.

Referring to FIG. 7, an embodiment of a belt 700 with a strap 701, buckle 702, and apparatus 703 of the present invention as embellishments, wherein the apparatus 703 contains interchangeable ornaments 704. The strap 701, the buckle 702, and the apparatus 703 and the ornaments 704 can be of any of the suitable materials.

Figure 8:
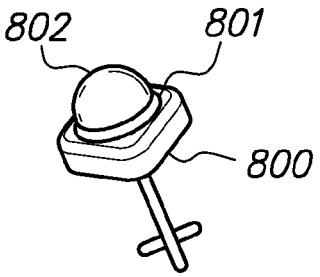
FIG. 8 is a perspective view of one embodiment of the basic construction of a cuff link using the present invention.

Referring to FIG. 8, an embodiment of a cuff link 800 with apparatus 801 of the present invention comprising the front of the cuff link, wherein the apparatus 801 contains an ornament 802 that are interchangeable. The cuff link 800 and the apparatus 801 and the ornament 802 can be made of a variety of materials.

Figure 9:
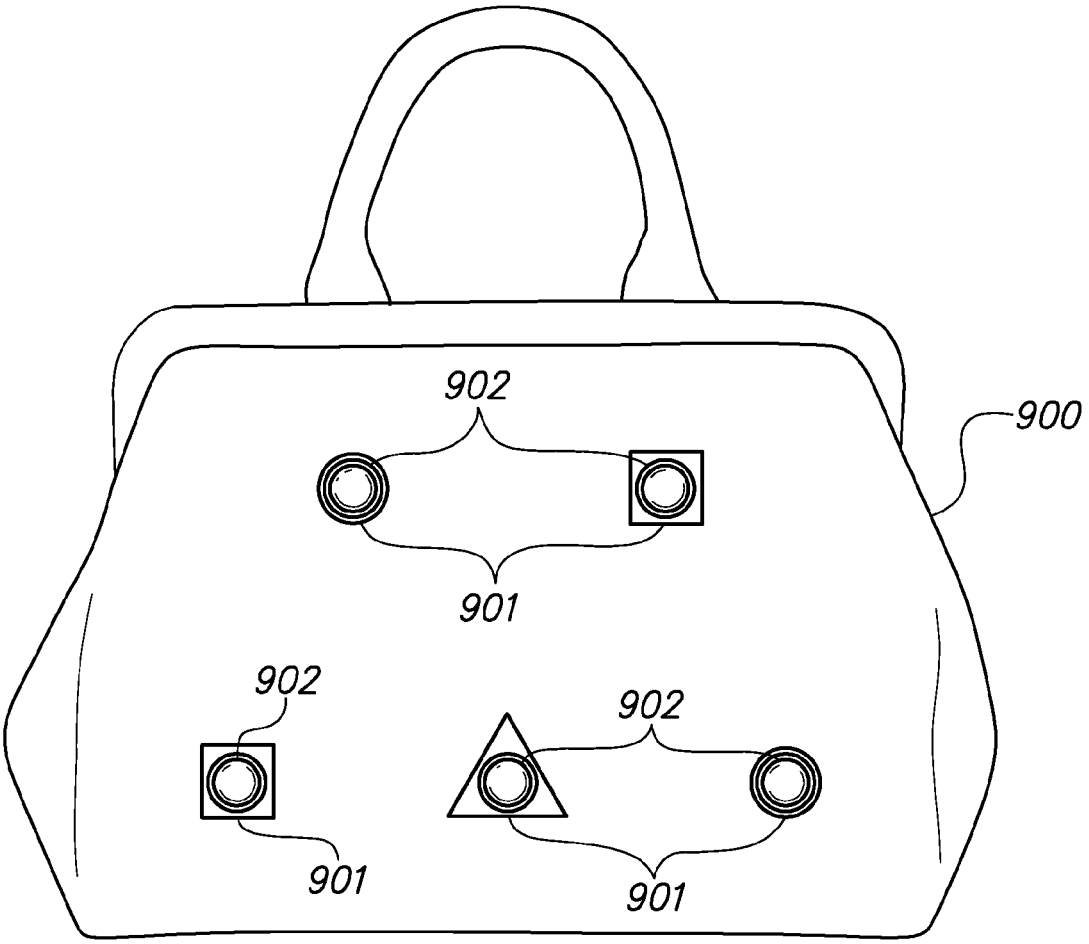
FIG. 9 is a perspective view of one embodiment of the basic construction of a purse using the present invention.

Referring to FIG. 9, an embodiment of a purse 900 embedded with apparatus of the present invention 901, wherein the apparatus 901 contains ornaments 902 that are interchangeable. The purse 900 and the apparatus 901 and the ornaments 902 can be of any material as are suitable.

Figure 10:
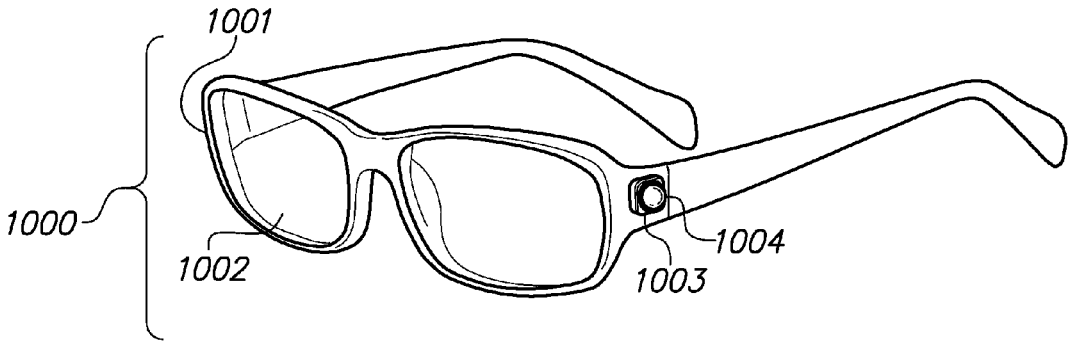
FIG. 10 is a perspective view of one embodiment of the basic construction of a pair of glasses using the present invention.

Referring to FIG. 10, an embodiment of a pair of glasses 1000 comprising a frame 1001, lenses 1002, and apparatus of the present invention 1003 for decoration, wherein the embedded apparatus 1003 contains interchangeable ornaments 1004. Also, the glasses frame 1001, the lens 1002, the apparatus 1003 and ornaments 1004 can be of any material as is suitable.

Figure 11:
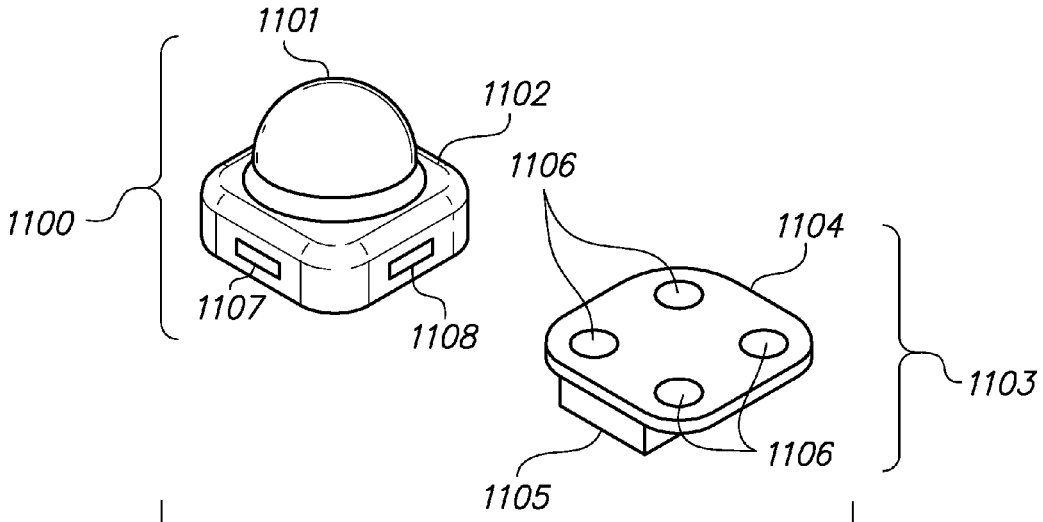
FIG. 11 is a diagram of the perspective view of one embodiment of the basic construction of the present invention with the light source separated from the ornament and base unit.

Referring to FIG. 11, a drawing of a perspective and close-up view of the apparatus of the present invention 1100 comprising a ornament 1101, a base 1102, and a lighting unit 1103, wherein the lighting unit is further comprised of a printed circuit board (PCB) 1104, battery 1105, and light source 1106. The ornament 1101 can be made of any material, but a translucent or transparent material allowing the light source 1106 embedded on the lighting unit 1103 to illuminate through the material is preferred. The base unit 1102 includes a control 1107, wherein the control 1107 can be but is not limited to a switch, a button, or touch sensor as in this embodiment, to control both or either the color and/or the intensity of the illumination as well as powering it on/off. Furthermore, the base unit 1102 also functions as the site 1108 for inserting and placing the removable lighting unit 1103, wherein the lighting unit 1103 comprises printed circuit board (PCB) or other circuit board 1104, battery or other power sources 1105, and lighting source such as light emitting diodes or other light sources 1106. The lighting unit 1103 can be interchanged with others with different light source 1106 to provide other colors or intensity of illumination or quantities of light sources. The ability to easily separate the lighting unit 1103 from the base unit 1102 for replacement provides an easy method for modification or repair.

Figure 12:
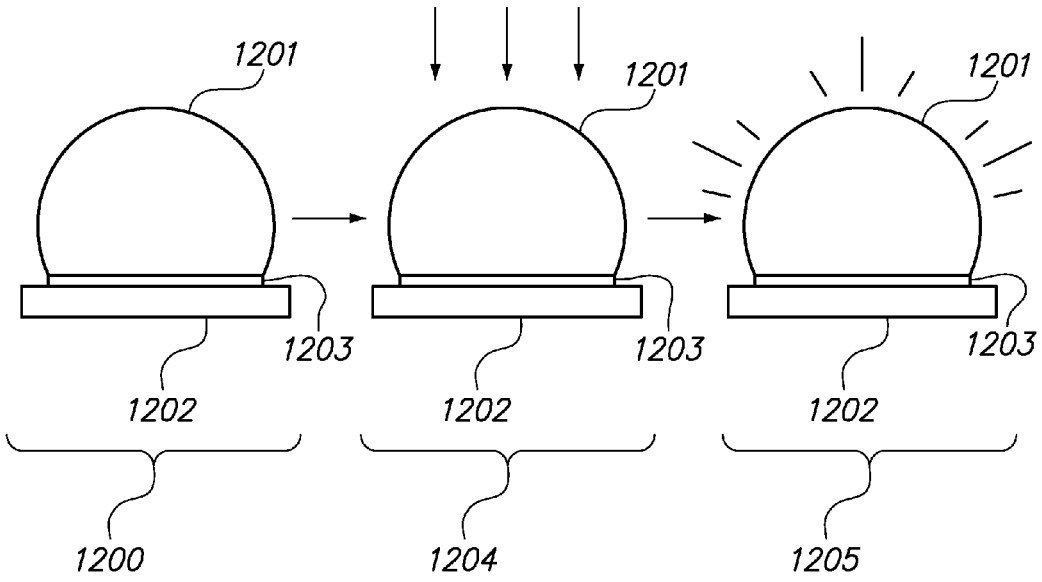
FIG. 12 is a diagram of an apparatus with a pressurized or button control mechanism for controlling the intensity or color of the illumination, or to turn on or off the illumination.

Referring to FIG. 12 is a drawing of an apparatus of the present invention 1200 with an ornament unit 1201, a base unit 1202, and a pressure or button mechanism 1203 for controlling the color or intensity of the illumination or to turn on or off the illumination. For example, initially, the apparatus 1200 is illuminating a certain color at a certain intensity. Upon pressing down on the ornament 1201, the mechanism 1203 is activated as shown in 1204. After releasing the depressed mechanism 1203 to allow it to revert back to the original position as shown in 1205, the apparatus 1201 illuminates at a different color or intensity. The pressurized or button mechanism can also be used to turn on or off the illumination of the apparatus.

Figure 13:
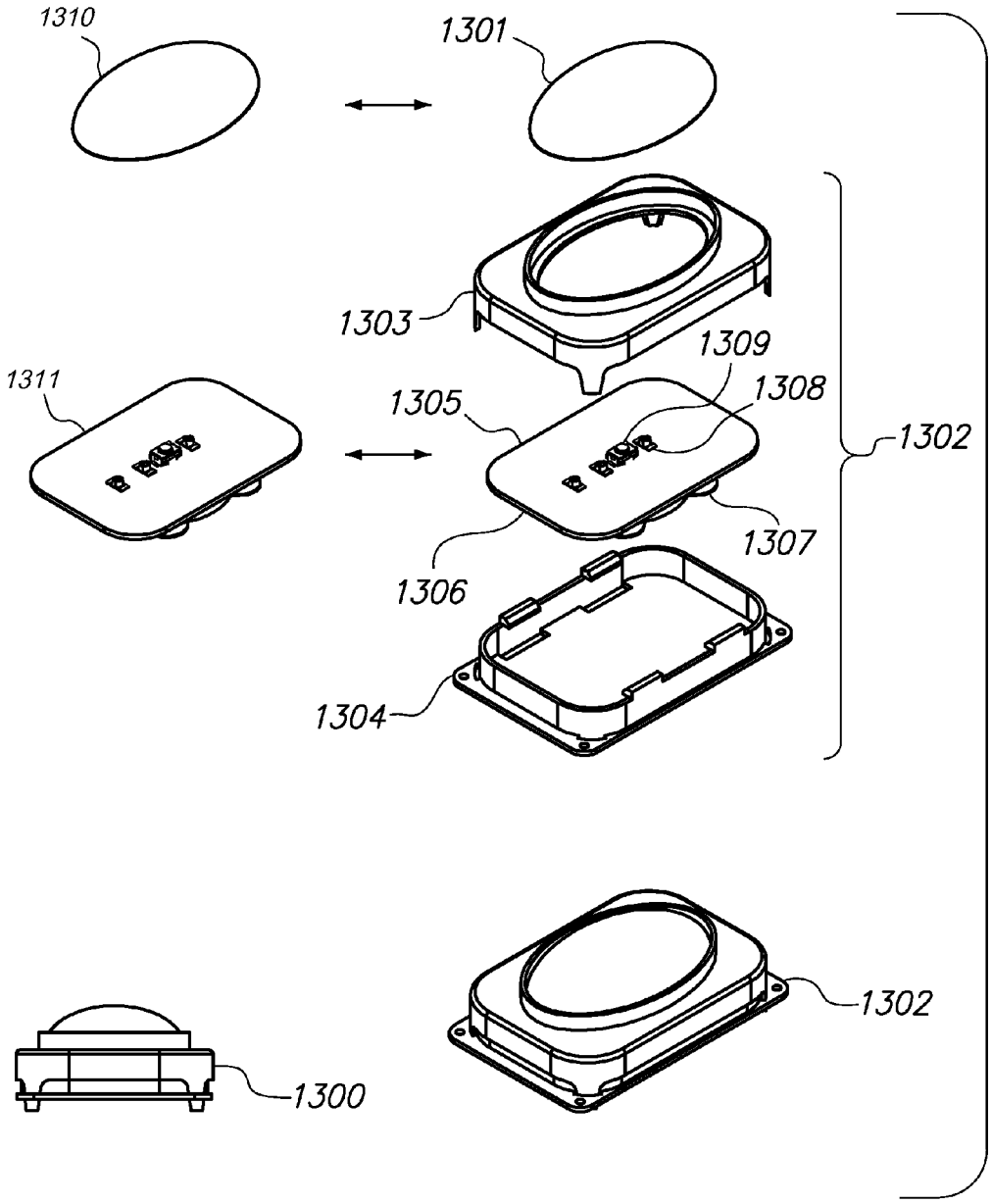
FIG. 13 is an exploded view drawing of a diagram of one embodiment showing the base unit with PCB, light unit, and the removable ornament unit.

Referring to FIG. 13, the assembly of the present invention 1300 includes the ornament unit 1301 attaching to a base unit 1302, wherein the base unit 1302 is comprised of a front cover 1303, back cover 1304, and the light unit 1305. In one embodiment, a second ornament unit 1310 is replaceable and exchangeable with ornament unit 1301. In another embodiment the ornament 1301 and front cover 1303 could be comprised as one unit and be exchangeable with another unit having an ornament and a front cover. The light unit 1305 is further comprised of PCB Circuit Board which is a type of connectivity apparatus 1306, battery 1307, and pressure control button 1309 and Light Emitting Diodes lights 1308. In one embodiment, a second light unit 1311 having different light color or light pattern which also is comprised of PCB Circuit Board, battery and light source, is replaceable and exchangeable with light unit 1305. Separating the front cover 1303 and back cover 1304 of the base unit 1302 allows the light unit 1305 to be accessed and be taken out and replaced with another one. In an alternate embodiment, the interchangeable portable unit 1305 can slide out from the base unit 1302 through a rear access door.

Figure 14:
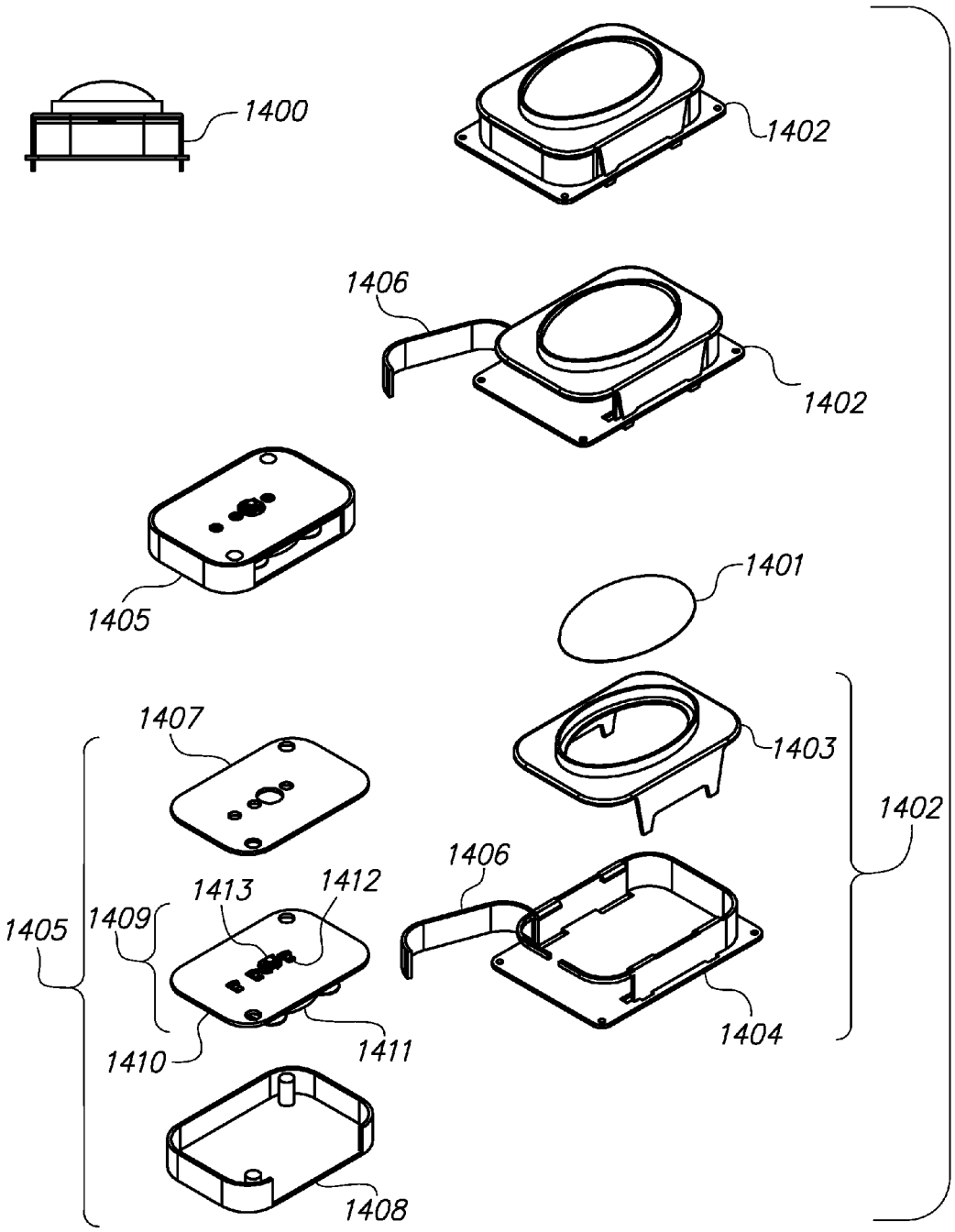
FIG. 14 is an exploded view drawing of a diagram of one embodiment showing the base unit with alternative method of interchanging the removable light unit and the removable ornament unit.

Referring to FIG. 14, the assembly of the apparatus 1400 includes the ornament unit 1401 attaching to the base unit 1402, wherein the base unit 1402 is comprised of a front cover 1403 and back cover 1404. In another embodiment the ornament 1401 and front cover 1403 could be comprised as one unit and be exchangeable with another unit having an ornament and a front cover. Furthermore, within the base unit 1402 is an interchangeable portable unit 1405 that can slide out from the base unit 1402 through a swing gate 1406, allowing for efficient interchange of the portable unit 1405. In an alternate embodiment, the interchangeable portable unit 1405 can slide out from the base unit 1402 through a rear access door. The portable unit 1405 is comprised of a front casing 1407 and back casing 1408, wherein lies the lighting unit 1409 comprising the PCB Circuit Board which is a type of connectivity apparatus 1410, the battery 1411, the pressure control button 1413, and the light source 1412. By opening the swing gate 1406 of the base unit 1402 or the back cover 1404, the portable unit 1405 can be easily and quickly swapped with another portable unit for the exchange.

Figure 15:
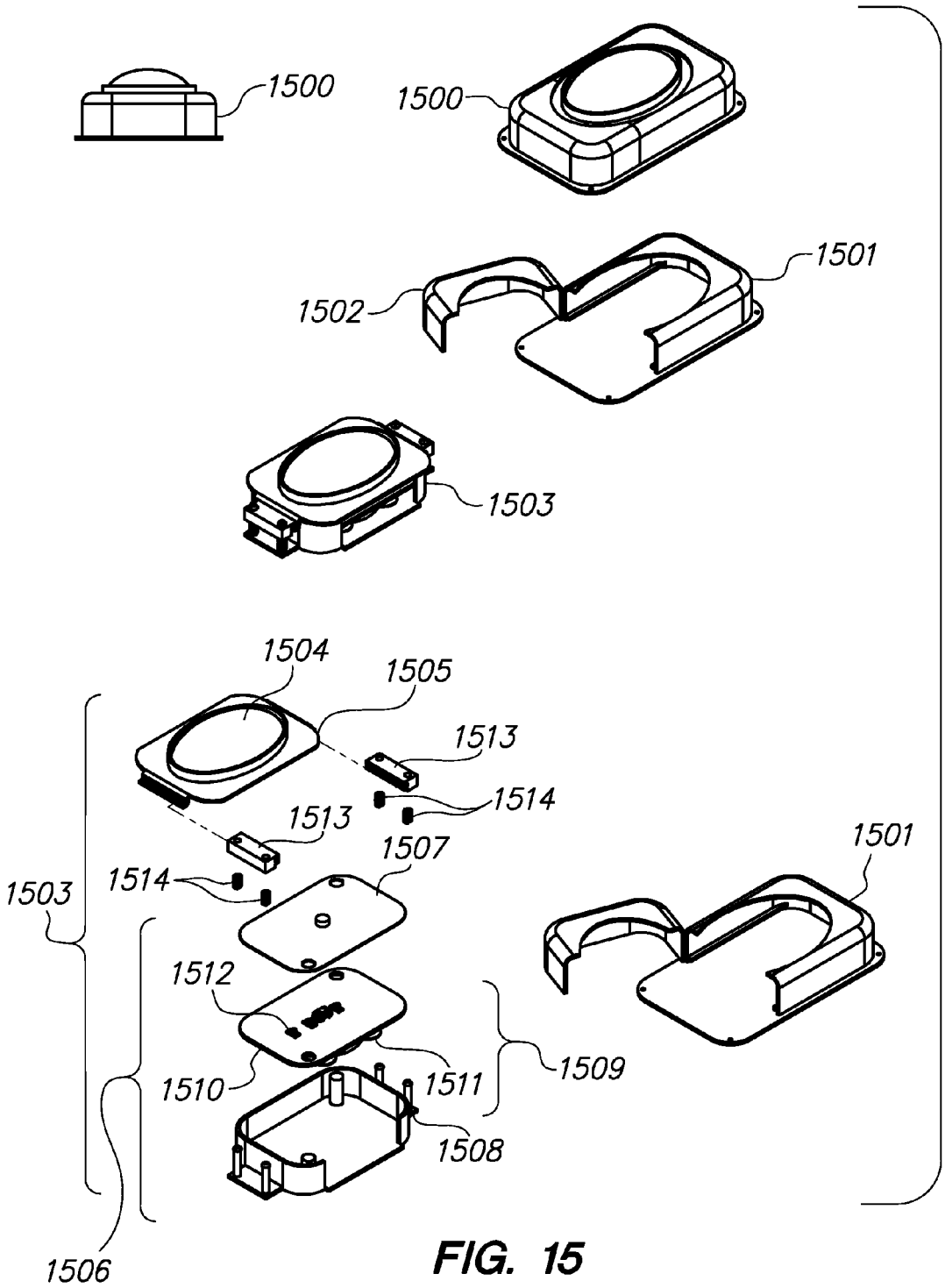
FIG. 15 is an exploded view drawing of a diagram of one embodiment showing the base unit with an interchangeable ornament and light unit wherein the ornament and light can be removed from the base unit.

Referring to FIG. 15, the apparatus 1500 is comprised of a base unit 1501 with a swing gate 1502, wherein within the base unit 1501 is a portable ornament light unit 1503. The portable ornament light unit 1503 is comprised of an ornament unit 1504, a ornament mounting bracket 1505, and a portable unit 1506, wherein the portable unit 1506 is further comprised of a top cover 1507, a bottom cover 1508, and a light unit 1509 in between, wherein the light unit 1509 is comprised of PCB Circuit Board 1510, battery 1511, and light source 1512. The ornament mounting bracket 1505 and the portable unit 1506 is secured with mounting tabs 1513 and screws 1514. By releasing the swing gate 1502 of the base unit 1501, portable ornament light unit 1503 can slide out for exchange.

The invention claimed is:

1. A light emitting apparatus for decorative function wherein said apparatus is comprised of a base unit; a first ornament unit wherein said first ornament unit is mounted on said base unit;

said base unit further comprises a first light unit wherein said first light unit emits light through said first ornament unit when said first ornament unit is mounted on said base unit;

said first light unit is encased within said base unit; said first light unit is removable from said base unit and replaceable by a second light unit;

said first ornament unit is removable from said base unit and replaceable by a second ornament unit;

wherein said first or second ornament unit is joined to said base unit without threads thereby allowing said first or second ornament unit to be removed from said base unit quickly;

wherein said second ornament unit is comprised of a second ornament wherein said second ornament is removable from said second ornament unit;

wherein said base unit is a hollow housing, said hollow housing comprises a front cover and a back cover, the front cover further comprising a rounded rectangle shaped perimeter wall; wherein said hollow housing receives at least one of said light unit and said ornament unit through a side opening of the hollow housing; and wherein a portion of the front cover is hinged on said perimeter wall and comprises a swing gate which opens to provide access to said side opening.

2. The apparatus of claim 1 wherein said base unit further comprises a switch unit wherein said switch unit controls the lighting of said light unit.

3. The apparatus of claim 1 wherein said first and second light units are comprised of one or more light sources and one or more power sources.

4. The apparatus of claim 3 wherein said first and second light units are further comprised of at least a circuit board or a connectivity apparatus.

5. The apparatus of claim 1 wherein said first light unit emits different light than said second light unit.

6. The apparatus of claim 1 wherein said first light unit emits different light pattern than said second light unit.

7. The apparatus of claim 1 wherein said ornament unit is comprised of at least one gem stone.

8. The apparatus of claim 1 wherein said apparatus is mounted on an accessory.

9. The apparatus of claim 1 wherein said apparatus is an accessory.

10. A method to illuminate an ornament comprising utilizing a light emitting apparatus for decorative function wherein said apparatus is comprised of a base unit; a first ornament unit wherein said first ornament unit is mounted on said base unit;

said base unit further comprises a first light unit wherein said first light unit emits light through said first ornament unit when said first ornament unit is mounted on said base unit;

said first light unit is encased within said base unit; said first light unit is removable from said base unit and replaceable by a second light unit;

said first ornament unit is removable from said base unit and replaceable by a second ornament unit;

wherein said first or second ornament unit is joined to said base unit without threads thereby allowing said first or second ornament unit to be removed from said base unit quickly;

wherein said second ornament unit is comprised of a second ornament wherein said second ornament is removable from said second ornament unit;

wherein said base unit is a hollow housing, said hollow housing comprises a front cover and a back cover, the front cover further comprising a rounded rectangle shaped perimeter wall; wherein said hollow housing receives at least one of said light unit and said ornament unit through a side opening of the hollow housing; and wherein a portion of the front cover is hinged on said perimeter wall and comprises a swing gate which opens to provide access to said side opening.

11. The method of claim 10 wherein said base unit further comprises a switch unit wherein said switch unit controls the lighting of said light unit.

12. The method of claim 10 wherein said first and second light units are comprised of one or more light sources and one or more power sources.

13. The method of claim 12 wherein said first and second light units are further comprised of at least a circuit board or a connectivity apparatus.

14. The method of claim 10 wherein said first light unit emits different light than said second light unit.

15. The method of claim 10 wherein said first light unit emits a different light pattern than said second light unit.

16. A light emitting apparatus for decorative function wherein said apparatus is comprised of a base unit; an ornament unit wherein said ornament unit is mounted on said base unit; said base unit further comprises a portable unit wherein said portable unit comprises a light unit wherein said light unit emits light through said ornament unit when said ornament unit is mounted on said base unit and when said portable unit is within said base unit;

said light unit is encased within said portable unit; said portable unit is removable from said base unit; said ornament unit is removable from said base unit; said light unit is removable from said portable unit;

wherein said first or second ornament unit is joined to said base unit without threads thereby allowing said first or second ornament unit to be removed from said base unit quickly;

wherein said second ornament unit is comprised of a second ornament wherein said second ornament is removable from said second ornament unit;

wherein said base unit is a hollow housing, said hollow housing comprises a front cover and a back cover, the front cover further comprising a rounded rectangle shaped perimeter wall; wherein said hollow housing receives at least one of said light unit and said ornament unit through a side opening of the hollow housing; and wherein a portion of the front cover is hinged on said perimeter wall and comprises a swing gate which opens to provide access to said side opening.

17. The apparatus of claim 16 wherein said ornament unit is mounted on said front cover.

18. The apparatus of claim 16 wherein said light unit is comprised of one or more light sources and one or more power sources.

19. The apparatus of claim 18 wherein said first and second light units are further comprised of at least a circuit board or a connectivity apparatus.

20. A light emitting apparatus for decorative function wherein said apparatus is comprised of a base unit and a portable ornament light unit wherein said portable ornament light unit is comprised of an ornament unit and a portable unit wherein said ornament unit is mounted on said portable unit; said portable unit further comprises a light unit wherein said light unit emits light through said ornament unit when said ornament unit is mounted on said portable unit; said portable ornament light unit is encased within said base unit; said portable ornament light unit is removable from said base unit; said ornament unit is removable from said portable unit; said light unit is removable from said portable unit;

wherein said first or second ornament unit is joined to said base unit without threads thereby allowing said first or second ornament unit to be removed from said base unit quickly;

wherein said second ornament unit is comprised of a second ornament wherein said second ornament is removable from said second ornament unit;

wherein said base unit is a hollow housing, said hollow housing comprises a front cover and a back cover, the front cover further comprising a rounded rectangle shaped perimeter wall; wherein said hollow housing receives at least one of said light unit and said ornament unit through a side opening of the hollow housing; and wherein a portion of the front cover is hinged on said perimeter wall and comprises a swing gate which opens to provide access to said side opening.

21. The apparatus of claim 18 wherein said light unit is encased within said front cover and said back cover.

22. The apparatus of claim 20 wherein said light unit is comprised of one or more light sources and one or more power sources.

23. The apparatus of claim 20 wherein said ornament unit is mounted on a ornament mounting bracket wherein said ornament mounting bracket is mounted on said portable unit via at least one attachment device.

24. The apparatus of claim 2 wherein said switch unit is a pressure button positioned between said ornament unit and said base unit wherein application of pressure on said ornament unit activates said switch unit wherein said switch unit controls the intensity or color or pattern of said light unit.

25. The apparatus of claim 3 wherein said first and second light units are further comprised of at least a switch.

* * * * *